US012673361B2

(12) United States Patent
Fujimoto et al.

(10) Patent No.: US 12,673,361 B2
(45) Date of Patent: Jul. 7, 2026

(54) SLIDING NOZZLE APPARATUS

(71) Applicant: KROSAKIHARIMA CORPORATION, Fukuoka (JP)

(72) Inventors: Takeshi Fujimoto, Fukuoka (JP); Akira Otsuka, Fukuoka (JP); Toshihiro Imahase, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 54 days.

(21) Appl. No.: 17/635,095

(22) PCT Filed: Aug. 17, 2020

(86) PCT No.: PCT/JP2020/030966
§ 371 (c)(1),
(2) Date: Feb. 14, 2022

(87) PCT Pub. No.: WO2021/033659
PCT Pub. Date: Feb. 25, 2021

(65) Prior Publication Data

US 2022/0288675 A1 Sep. 15, 2022

(30) Foreign Application Priority Data

Aug. 21, 2019 (JP) ..... 2019-151498

(51) Int. Cl.
*B22D 41/34* (2006.01)
*B22D 11/10* (2006.01)
*B22D 41/22* (2006.01)

(52) U.S. Cl.
CPC ..... *B22D 41/34* (2013.01); *B22D 11/10* (2013.01); *B22D 41/22* (2013.01)

(58) Field of Classification Search
CPC ..... B22D 41/34; B22D 11/10; B22D 41/38; B22D 41/40; B22D 41/22; B22D 41/24;
(Continued)

(56) References Cited

U.S. PATENT DOCUMENTS 4,596,345 A * 6/1986 Beckers ..... B22D 41/38 403/328
9,505,056 B2 11/2016 Yamamoto et al.
(Continued)

FOREIGN PATENT DOCUMENTS

CA 29667 A1 * 5/2016 ..... B22D 41/28
CN 106378446 A * 2/2017 ..... B22D 41/56
(Continued)

OTHER PUBLICATIONS

International Search Report dated Aug. 27, 2020 for PCT/JP2020/030966, filed Aug. 17, 2020 and Written Opinion for PCT/JP2020/030966.
(Continued)

*Primary Examiner* — Keith D. Hendricks
*Assistant Examiner* — Nikolas Takuya Pullen
(74) *Attorney, Agent, or Firm* — Fleit Intellectual Property Law; Paul D. Bianco; Katharine Davis Wong

(57) ABSTRACT

A sliding nozzle apparatus, configured to allow a drive unit to be attached to and detached from a slide metal frame, efficiently transmits a driving force of the drive unit to the slide metal frame. The sliding nozzle apparatus comprises a connection component attached to a slide metal frame and configured for connection with a drive unit. The connection component is provided with an opening with respect to which the drive unit can be attached and detached. The connection component is configured to allow the opening to be switched between a first position where the opening faces in the same direction as an opening-closing direction of the slide metal frame, and a second position where the opening faces in the same direction as an attaching-detaching direction of the drive unit.

7 Claims, 6 Drawing Sheets

(58) Field of Classification Search
CPC ..... B22D 41/26; B22D 41/28; B22D 41/30; B22D 41/32; B22D 41/36; F16K 3/16
USPC ..... 222/600
See application file for complete search history.

(56) References Cited

U.S. PATENT DOCUMENTS

| | | | | |
|---|---|---|---|---|
| 10,464,128 | B2 | 11/2019 | Imahase et al. | |
| 10,471,504 | B2 | 11/2019 | Imahase et al. | |
| 2018/0001379 | A1* | 1/2018 | Imahase | B22D 11/10 |

FOREIGN PATENT DOCUMENTS

| | | | | | |
|---|---|---|---|---|---|
| JP | U S56-015000 | | | 7/1979 | |
| JP | S56-0150000 | | * | 2/1984 | C21C 5/46 |
| JP | 2014008512 | A | | 1/2014 | |
| JP | 2016064439 | A | | 4/2016 | |
| JP | 2016-097411 | A | | 5/2016 | |
| JP | 2016-159317 | A | | 9/2016 | |
| JP | 2017-109207 | A | | 6/2017 | |
| JP | 2019-058930 | A | | 4/2019 | |
| WO | 2017/033953 | A | | 3/2017 | |
| WO | 2017033953 | A1 | | 3/2017 | |

OTHER PUBLICATIONS

For PCT/JP2020/030966, filed Aug. 17, 2020: International Preliminary Report on Patentability, dated Feb. 17, 2022 Written Opinion, dated Sep. 15, 2020 (English translation).

* cited by examiner

Fig. 5
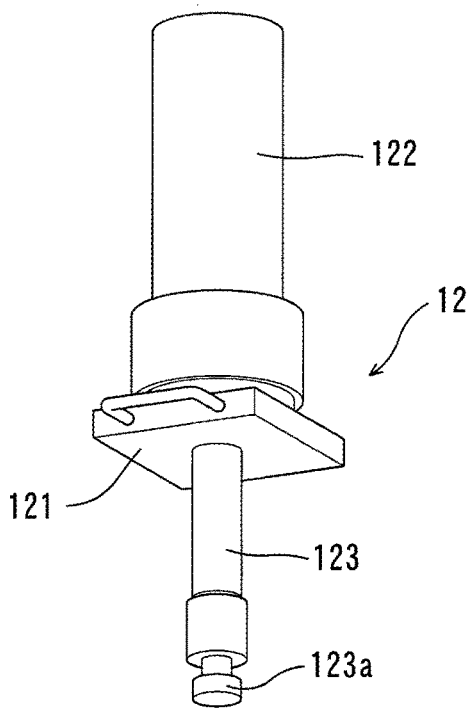
Fig. 6A
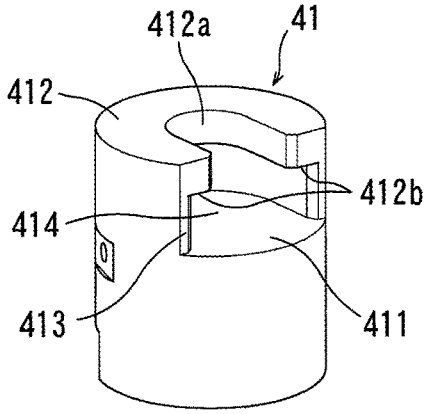
Fig. 6B
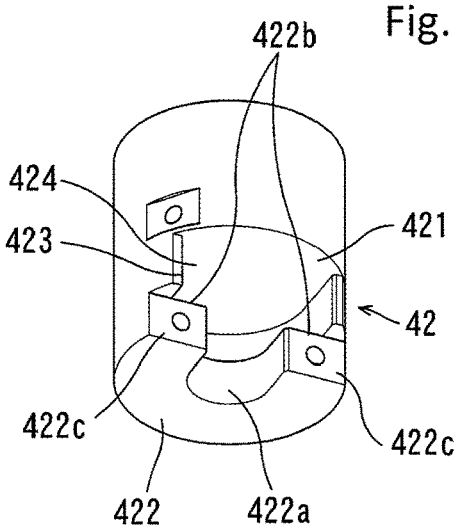
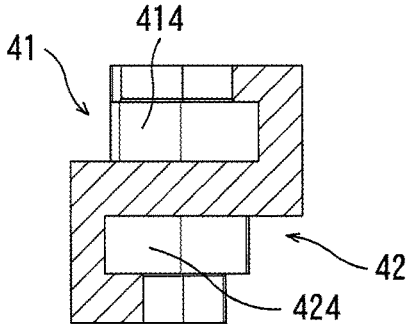
Fig. 6C

SLIDING NOZZLE APPARATUS

TECHNICAL FIELD

The present invention relates to a sliding nozzle apparatus for controlling the flow rate of molten steel.

BACKGROUND ART

A sliding nozzle apparatus is configured such that one of two or three refractory plates each having a nozzle hole is slid while the refractory plates are clamped together at a high pressure (while they are applied or loaded with a surface pressure between adjacent ones thereof), thereby changing the degree of opening among the nozzle holes to control the flow rate of molten metal. This plate to be slid is held by a slide metal frame, wherein the slide metal frame is provided such that it is openable and closable with respect to a fixed metal frame so as to allow replacement of the plates.

The plates reach the end of their usable life after they are used several times. Thus, during replacement of the plates or when checking a damage state of the plates, the slide metal frame needs to be opened. In this process, it is necessary to release or unload the surface pressure before opening the slide metal frame, and then load the surface pressure after closing the slide metal frame.

As one method to load or unload the surface pressure in the sliding nozzle apparatus, there has been known a method to load or unload the surface pressure in accordance with sliding of the slide metal frame. This method includes a type in which the sliding of the slide metal frame when loading or unloading the surface pressure is performed in a range outside a sliding range during casting. In this type, two drive units having different strokes are used during casting and during the surface pressure loading/unloading operation, respectively, i.e., it is necessary to conduct an operation of performing replacement between the two drive units having different strokes, with respect to the slide metal frame.

Heretofore, as the type of sliding nozzle apparatus configured to allow replacement between two drive units having different strokes, with respect to a slide metal frame, there have been known sliding nozzle apparatuses as disclosed in the below-mentioned Patent Documents 1 and 2.

CITATION LIST

Patent Document

Patent Document 1: Japanese Utility Model Application No. S54-097409 (Microfilm of JP-U S56-015000)

Patent Document 2: WO2017/033953

SUMMARY OF INVENTION

Technical Problem

In the Patent Document 1, a drive unit is detachably coupled to a slide metal frame via a coupling member. However, it is not supposed to open and close the slide metal frame in a state in which the drive unit and the slide metal frame are coupled together via the coupling member.

In the Patent Document 2, the sliding nozzle apparatus is configured such that a coupling portion of a drive unit and a coupling portion of a slide metal frame are engaged together, wherein the coupling portion of the drive unit is provided with two opening: one opening which faces in a right-left (lateral) direction (in a direction along which the drive unit is attached and detached) and is to be used when attaching and detaching the drive unit; and the other opening which faces in a front-back direction (in a direction along which the slide metal frame is opened and closed) and is to be used when opening and closing the slide metal frame. However, in this configuration, a contact area between the two coupling portions can be displaced in the right-left direction and in the front-back direction, thereby causing difficulty in efficiently transmitting a driving force of the drive unit to the slide metal frame.

A technical problem to be solved by the present invention is to, in a sliding nozzle apparatus configured to allow a drive unit to be attached to and detached from a slide metal frame, make it possible to efficiently transmit a driving force of the drive unit to the slide metal frame.

[Solution to Technical Problem]

The present invention provides a sliding nozzle apparatus having the following features.

1. A sliding nozzle apparatus comprising: a fixed metal frame; a slide metal frame provided such that it is openable and closable with respect to the fixed metal frame; a drive unit for sliding the slide metal frame; and a connection component attached to the slide metal frame and configured for connection with the drive unit, wherein the connection component is provided with a first opening with respect to which the drive unit can be attached and detached only in one direction, and wherein the connection component is configured to allow the first opening to be switched between a first position where the first opening faces in a same direction as an opening-closing direction of the slide metal frame, and a second position where the first opening faces in a same direction as an attaching-detaching direction of the drive unit.
2. The sliding nozzle apparatus as described in the section 1, wherein the connection component is provided rotatably with respect to the slide metal frame, wherein the position of the first opening can be switched between the first position and the second position by rotating the connection component.
3. The sliding nozzle apparatus as described in the section 1, wherein the connection component is attached to the slide metal frame both during attaching and detaching of the drive unit and during opening and closing of the slide metal frame.
4. The sliding nozzle apparatus as described in the section 1, wherein the connection component has a wall facing in a sliding direction of the slide metal frame, wherein the wall has a recess in which at least a part of the drive unit is inserted, wherein the recess is configured to restrict the at least a part of the drive unit inserted in the recess to be displaced in a direction orthogonal to the sliding direction of the slide metal frame.
5. The sliding nozzle apparatus as described in the section 1, wherein the connection component is provided with a second opening to which the slide metal frame is mountable, wherein the first opening and the second opening are provided such that they face in opposite directions.
6. The sliding nozzle apparatus as described in the section 1, wherein the fixed metal frame has a bottom plate extending toward the drive unit, wherein the fixed metal frame is configured to have a gap between the bottom plate and the connection component.

Effect of Invention

In the sliding nozzle apparatus configured to allow the drive unit to be attached to and detached from the slide metal frame, the present invention makes it possible to efficiently transmit a driving force of the drive unit to the slide metal frame via the connection component.

BRIEF DESCRIPTION OF DRAWINGS

FIG. 5 is an enlarged perspective view of a relevant part of the drive unit itself.

FIGS. 6A-6C illustrate a connection component independently, wherein FIG. 6A and FIG. 6B are, respectively, a perspective view showing a first connection part of the connection component to be connected to the drive unit, and a perspective view showing a second connection part of the connection component to be connected to the slide metal frame, and FIG. 6C is a longitudinal sectional view of the connection component.

FIGS. 7A and 7B illustrate a relevant part of the slide metal frame to which the connection component is mounted, wherein FIG. 7A is a perspective view showing a state in which a first opening of the connection component is at a first position, and FIG. 7B is a perspective view showing a state in which the first opening of the connection component is at a second position.

DESCRIPTION OF EMBODIMENTS

An embodiment of the present invention will be described in detail, based on the drawings.

Figure 1:
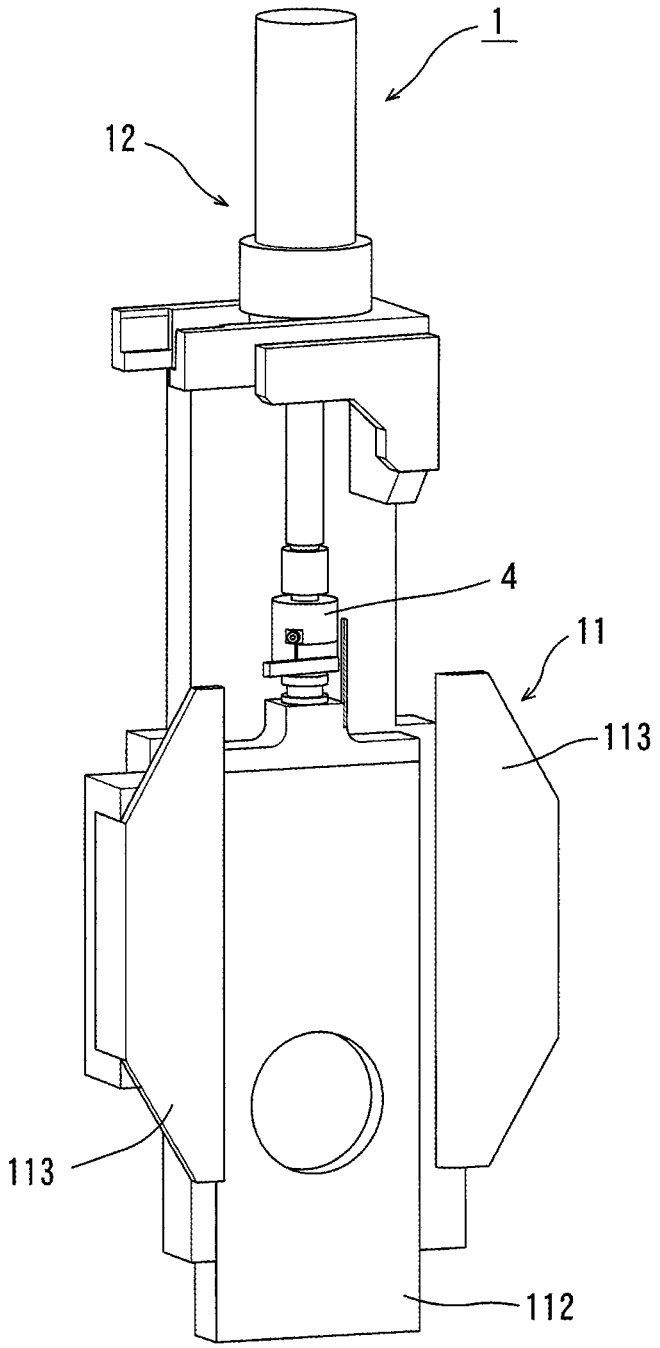
FIG. 1 is a perspective view of a sliding nozzle apparatus according to one embodiment of the present invention (in a state in which a slide metal frame is closed).
Figure 2:
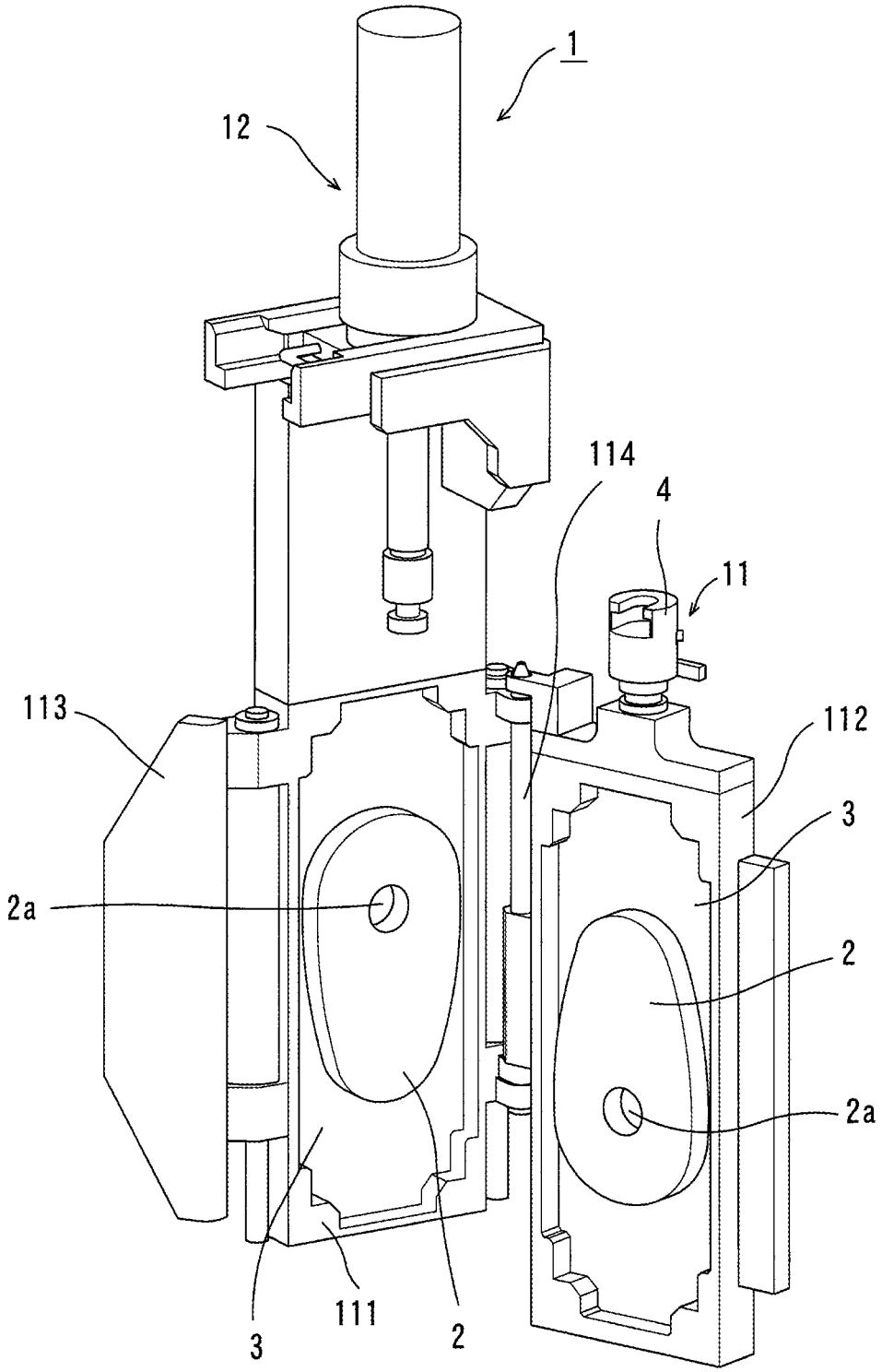
FIG. 2 is a perspective view of the sliding nozzle apparatus according to this embodiment (in a state in which the slide metal frame is opened).
Figure 3:
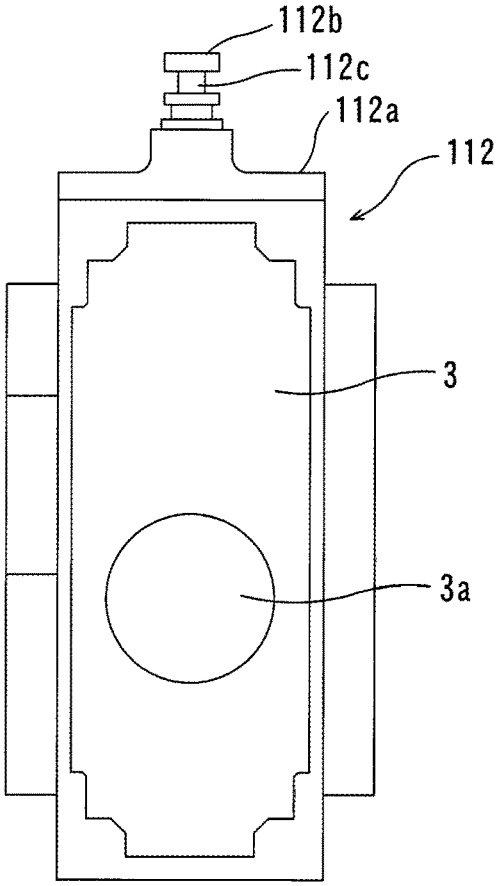
FIG. 3 is a front view independently showing the slide metal frame of the sliding nozzle apparatus illustrated in FIGS. 1 and 2.

FIGS. 1 and 2 show a sliding nozzle apparatus 1 according to this embodiment. Specifically, FIG. 1 shows a state in which the after-mentioned slide metal frame 112 is closed, and FIG. 2 shows a state in which the after-mentioned slide metal frame 112 is opened. Further, FIG. 3 independently shows the after-mentioned slide metal frame 112. It should be noted here that, since the checking or replacement of the plates, and the loading or unloading of the surface pressure described above are performed in a state in which the sliding nozzle apparatus 1 is disposed to stand vertically, FIGS. 1 to 3 and the after-mentioned FIGS. 4 to 9 show the sliding nozzle apparatus 1 in the state in which it is disposed to stand vertically.

As shown in FIGS. 1 and 2, the sliding nozzle apparatus 1 comprises an apparatus body 11, and a drive unit 12.

The apparatus body 11 comprises: a fixed metal frame 111; a slide metal frame 112 provided such that it is slidable, and openable and closable with respect to the fixed metal frame 111; and two spring boxes 113 swingably provided, respectively, on both sides of the fixed metal frame 111.

Each of the fixed metal frame 111 and the slide metal frame 112 is an approximately rectangular plate-shaped member, and internally formed with a housing part 3 for housing the after-mentioned plate 2. The housing part 3 is provided with a through-hole 3*a* (see FIG. 3). The fixed metal frame 111 is fixed to the bottom of a molten metal container such as a ladle, by a non-illustrated bolt.

A coupling frame 112*a* is provided at one (closer to the drive unit 12) of opposed ends of the slide metal frame 112 in a sliding direction (longitudinal direction) of the slide metal frame 112. The coupling frame 112*a* has a columnar-shaped slide metal frame-side coupling part 112*b* provided on the side of an edge face thereof through a shank part 112*c*. The slide metal frame-side coupling part 112*b* is configured to allow a connection component 4 to be attached thereto.

It should be noted that, although, in this embodiment, the coupling frame 112*a* is formed as a component separate from the slide metal frame 112, it may be integrally formed with the slide metal frame 112.

As shown in FIGS. 1 and 2, the slide metal frame 112 is configured to be swingably openable and closable with respect to the fixed metal frame 111 about a pivot shaft 114. In a state in which the slide metal frame 112 is closed, the slide metal frame 112 can be clamped between the spring boxes 113 and the fixed metal frame 111. Further, in the closed state of the slide metal frame 112, the slide metal frame 112 can be slid in the sliding direction by the drive unit 12 coupled to the slide metal frame-side coupling part 112*b* via the connection component 4.

Two plates 2 each made of a refractory material are housed, respectively, in the housing parts 3 of the fixed metal frame 111 and the slide metal frame 112. Each of the plates 2 is provided with a nozzle hole 2*a*, and configured such that, when each of the plates 2 is housed in a corresponding one of the fixed metal frame 111 and the slide metal frame 112, the nozzle hole 2*a* is communicated with the through-hole 3*a* of the corresponding metal frame.

When the slide metal frame 112 is slid with respect to the fixed metal frame 111, the plate 2 housed in the slide metal frame 112 can also be slid in a state in which a sliding surface thereof is in contact with the plate 2 housed in the fixed metal frame 111.

Overlap between the nozzle hole 2*a* of the plate 2 in the slide metal frame 112 and the nozzle hole 2*a* of the plate 2 in the fixed metal frame 111 can be adjusted by sliding the slide metal frame 112 to adjust the position of the slide metal frame 112. By adjusting this overlap, it becomes possible to adjust the flow rate of molten metal to be discharged from the molten metal container during casting.

Here, in the sliding nozzle apparatus 1 according to this embodiment, a first drive unit 12*a* having a relatively short stroke is used during casting, and a second drive unit 12*b* having a relatively long stroke is used during loading or unloading of the surface pressure. That is, in the sliding nozzle apparatus 1 according to this embodiment, two drive units having different stokes are used during casting and during the surface pressure loading/unloading operation, respectively, so that it is necessary to conduct an operation of performing replacement between the two drive units having different stokes, with respect to the slide metal frame 112.

It should be noted here that a mechanism for loading or unloading the surface pressure in the sliding nozzle apparatus 1 according to this embodiment is the same as that of a conventionally commonly-used sliding nozzle apparatus, and therefore description thereof will be omitted.

Figure 4:
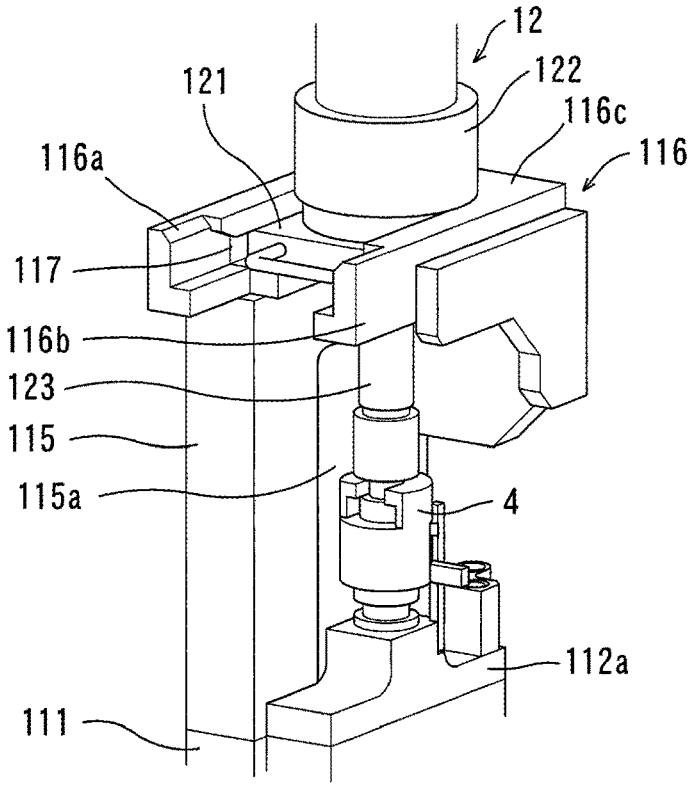
FIG. 4 is an enlarged perspective view of a coupling region between a drive unit and the slide metal frame.

FIG. 4 enlargedly shows a coupling region between the drive unit 12 and the slide metal frame 112, and FIG. 5 enlargedly shows a relevant part of the drive unit 12 itself. It should be noted that this embodiment will be described on the assumption that the first drive unit 12*a* having a relatively short stroke and the second drive unit 12*b* having a relatively long stroke are referred to collectively as "the drive unit 12". Except for stroke, the first drive unit 12*a* and the second drive unit 12*b* are substantially identical in terms of configuration.

The drive unit 12 comprises a base plate 121, a cylinder 122 coupled to the base plate 121, and a rod 123. For example, a hydraulic cylinder may be used as the cylinder 122. The base plate 121 has a rectangular shape, and the cylinder 122 is attached to the base plate 121 such that the rod 123 extending therefrom slidably penetrates through the base plate 121. The rod 123 is configured to be extendable and retractable by adjusting the pressure of the cylinder 122. By extending and retracting the rod 123, it becomes possible to slide the slide metal frame 112 coupled to the rod 123 via the connection component 4.

The rod 123 has a columnar-shaped drive unit-side coupling part 123*a* provided at a distal end thereof.

On the other hand, as shown in FIG. 4, an approximately rectangular-shaped bottom plate 115 is provided at one (closer to the drive unit 12) of opposed ends of the fixed metal frame 111 in a longitudinal direction of the fixed metal frame 111 (which is equal to the sliding direction of the slide metal frame 112), wherein the bottom plate 115 has one end fixed to the one end of the fixed metal frame 111, and extends toward the drive unit 12. A drive unit holder 116 is provided at the other end of the bottom plate 115. The drive unit holder 116 comprises a pair of arm parts 116*a*, 116*b* opposed to each other across a void space, and an arc-shaped inter-arm part 116*c* coupling part coupling respective one ends of the arm parts 116*a*, 116*b* together. In other words, the drive unit holder 116 is formed in a U shape which is opened in an attaching-detaching direction of the drive unit 12 (in this embodiment, a direction orthogonal to the sliding direction of the slide metal frame 112 and along a sliding surface of the slide metal frame 112). Further, each of the pair of arm parts 116*a*, 116*b* has a base plate insertion part 117 for allowing the base plate 121 of the drive unit 12 to be inserted therein. It should be noted that the bottom plate 115 may be integrally formed with the fixed metal frame 111.

Fixation of the drive unit 12 to the drive unit holder 116 is performed by inserting the base plate 121 with the rod 123 penetrating therethrough, into the drive unit holder 116. Specifically, lateral edges of the base plate 121 are inserted into the base plate insertion parts 117, and fixed to prevent the base plate 121 from moving in the sliding direction of the slide metal frame 112, and the rod 123 is inserted into the space between the pair of arm parts 116*a*, 116*b* of the drive unit holder 116.

In this embodiment, the base plate 121 with the rod 123 is inserted into the drive unit holder 116 in the same direction as the attaching-detaching direction of the drive unit 12.

In this way, the lateral edges of the base plate 121 are inserted into the base plate insertion parts 117, and fixed to the arm parts 116*a*, 116*b*. This makes it possible to reliably receive a reaction force during sliding of the slide metal frame 112, by the drive unit holder 116.

The slide metal frame-side coupling part 112*b* of the slide metal frame 112 and the drive unit-side coupling part 123*a* of the drive unit 12 are coupled together via the connection component 4.

As shown in FIGS. 6A-6C, the connection component 4 is a cylindrical-shaped member, and comprises a first connection part 41 to which the drive unit-side coupling part 123*a* is connected, and a second connection part 42 to which the slide metal frame-side coupling part 112*b* is connected.

The first connection part 41 is provided on the side of one end (closer to the drive unit 12) of the connection component 4, and has a first advance wall 411, a first retraction wall 412, and a first intermediate wall 413 coupling the first advance wall 411 and the first retraction wall 412 together. A void space is formed between the first advance wall 411 and the first retraction wall 412, wherein the void space has a first opening 414 surrounded by the first advance wall 411, the first retraction wall 412 and the first intermediate wall 413.

The first retraction wall 412 has a U shape whose central region is formed as a first through-recess 412*a* to which at least a part of the rod 123 is inserted. Further, the first retraction wall 412 defines a first step 412*b* in cooperation with the first intermediate wall 413.

At least a part of the drive unit-side coupling part 123*a* can be inserted into the first connection part 41 from the first opening 414. The drive unit-side coupling part 123*a* inserted in the first connection part 41 is located between the first advance wall 411 and the first step 412*b* of the first retraction wall 412, so that displacement in an up-down direction (in the sliding direction of the slide metal frame 112) is restricted.

The second connection part 42 is provided on the side of the other end (closer to the slide metal frame 112) of the connection component 4, and has a second advance wall 421, a second retraction wall 422, and a second intermediate wall 423 coupling the second advance wall 421 and the second retraction wall 422 together. A void space is formed between the second advance wall 421 and the second retraction wall 422, wherein the void space has a second opening 424 surrounded by the second advance wall 421, the second retraction wall 422 and the second intermediate wall 423.

The second retraction wall 422 has a U shape whose central region is formed as a second through-recess 422*a* to which at least a part of the shank part 112*c* extending from the slide metal frame-side coupling part 112*b* is inserted. Further, the second retraction wall 422 has a mounting face 422*c* provided at an edge thereof to allow the after-mentioned stationary bar 5 to be fixed thereto. Further, the second retraction wall 422 defines a second step 422*b* in cooperation with the second intermediate wall 423.

At least a part of the slide metal frame-side coupling part 112*b* can be inserted into the second connection part 42 from the second opening 424. The slide metal frame-side coupling part 112*b* inserted in the second connection part 42 is located between the second advance wall 421 and the second step 422*b* of the second retraction wall 422, so that displacement in the up-down direction (in the sliding direction of the slide metal frame 112) is restricted.

In this embodiment, the intermediate wall (413, 423) is a wall coupling the advance wall (411, 421) with lower, right and left regions of the retraction wall (412, 422). Thus, when the coupling part (123*a*, 112*b*) is inserted in the region (void space) surrounded by these walls, upper, lower, right and left regions of the coupling part (123*a*, 112*b*) are surrounded, so that the coupling part (123*a*, 112*b*) can be detached only in one direction (a direction toward the opening (414, 424)). Further, although the coupling part (123*a*, 112*b*) moves back and forth between the advance wall (411, 421) and the retraction wall (412, 422) during use (during casting), the through-recess (412, 422) provided in the retraction wall (412, 422) guides the coupling part (123*a*, 112*b*), so that the coupling part (123*a*, 112*b*) becomes unlikely to be displaced in a lateral direction (direction orthogonal to the sliding direction of the slide metal frame 112), thereby facilitating transmission of a driving force of the drive unit 12.

Specifically describing the transmission of a driving force of the drive unit 12, during an operation of extending the rod 123 of the drive unit 12 to cause the slide metal frame 112 to be advanced (moved forwardly), the drive unit-side coupling part 123*a* and the slide metal frame-side coupling part 112*b* are brought into contact with the first advance wall 411 and the second advance wall 421, respectively. In this process, the driving force of the drive unit 12 is transmitted, via the drive unit-side coupling part 123*a*, from the first advance wall 411 to the second advance wall 421, and further transmitted to the slide metal frame-side coupling part 112*b*.

On the other hand, during an operation of contracting the rod 123 of the drive unit 12 to cause the slide metal frame 112 to be retracted (moved backwardly), the drive unit-side coupling part 123*a* and the slide metal frame-side coupling part 112*b* are brought into contact with the first retraction wall 412 and the second retraction wall 422, respectively. In this process, the driving force of the drive unit 12 is transmitted, via the drive unit-side coupling part 123*a*, from the first retraction wall 412 to the second retraction wall 422, and further transmitted to the slide metal frame-side coupling part 112*b*.

In this embodiment, the first opening 414 and the second opening 424 face in different directions. In the case where the first opening 414 and the second opening 424 face in different directions, as just described, it becomes possible to avoid, e.g., a situation where the engagement between the connection component 4 and the slide metal frame-side coupling part 112*b* is erroneously released when the drive unit-side coupling part 123*a* is attached to or detached from the connection component 4.

More preferably, the first opening 414 and the second opening 424 mutually face in opposite directions (180-degree opposite directions), as shown in FIGS. 6A-6C. In the case where the first opening 414 and the second opening 424 mutually face in opposite directions, as just described, it becomes easier to maintain the strength of the connection component 4 since the openings are not located in adjacent relation. Further, in the case where the first opening 414 and the second opening 424 mutually face in opposite directions, the center of gravity of the connection component 4 is located near the center of the connection component 4. Thus, it becomes easier to ensure stability when the connection component 4 is rotated as described below.

As shown in FIG. 4, the bottom plate 115 attached to the fixed metal frame 111 is provided with a groove 115*a* for forming a gap with respect to the connection component 4.

In a surface pressure loaded state, the slide metal frame 112 is pressed toward the fixed metal frame 111 by the spring boxes 113, and therefore the connection component 4 connected to the slide metal frame 112 also comes closer to the fixed metal frame 111. In this process, the connection component 4 is disposed within the groove 115*a*, so that there is a gap between the bottom plate 115 and the connection component 4.

In a surface pressure unloaded state, the connection component 4 is also disposed within the groove 115*a*, so that there is a gap between the connection component 4 and the bottom plate 115.

This configuration makes it possible to prevent a situation where the connection component 4 is brought into contact with the bottom plate 115 during sliding of the slide metal frame 112 to cause wear damage of the connection component 4 and the bottom plate 115.

Figure 7A:
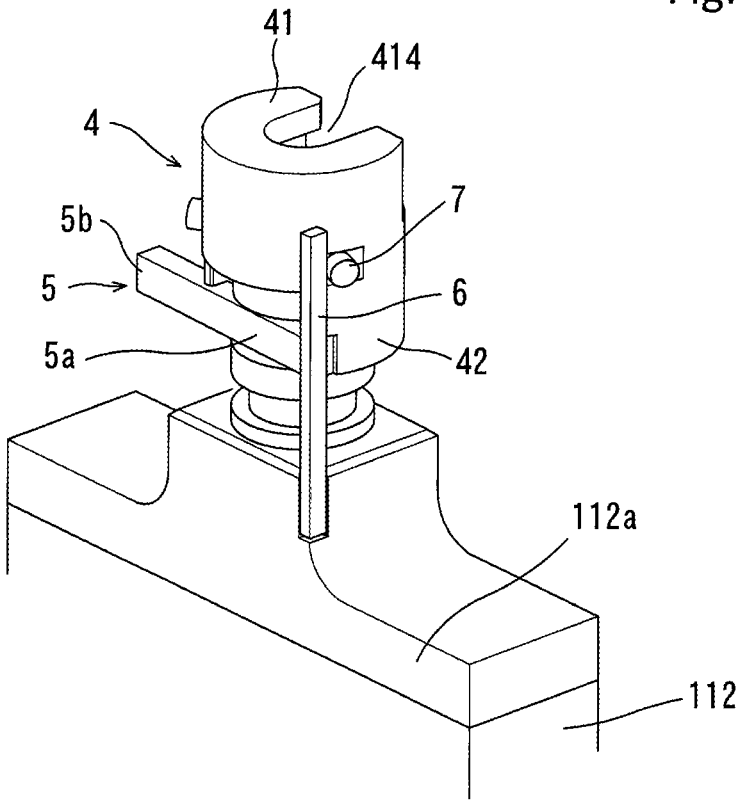
Figure 7B:
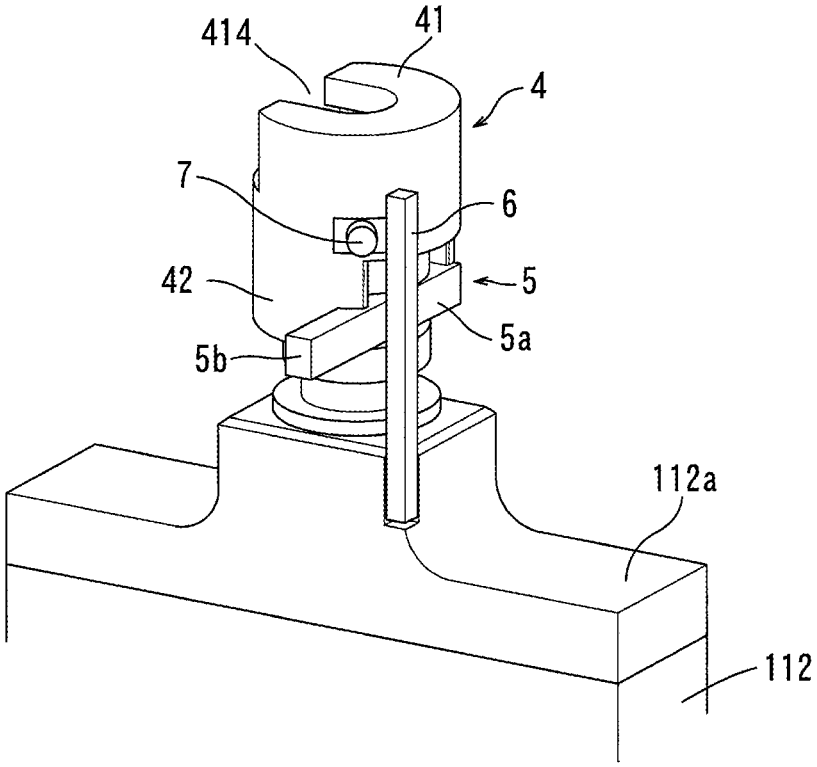

FIGS. 7A and 7B shows a state in which the connection component 4 is mounted to the slide metal frame 112.

In the state in which the connection component 4 is mounted to the slide metal frame 112, the connection component 4 is rotatable about a sliding directional central axis of the slide metal frame 112. More specifically, the connection component 4 is rotatable about the sliding directional central axis of the slide metal frame 112 in both clockwise and counterclockwise directions.

A stationary bar 5 is attached to the second connection part 42 of the connection component 4. The stationary bar 5 comprises a stationary part 5*a*, and a grip 5*b* extending from the stationary part 5*a*. The stationary part 5*a* is fixed to the mounting face 422*c* (FIGS. 6A-6C) of the second connection part 42.

Specifically, through an operation of inserting the slide metal frame-side coupling part 112*b* into the second opening 424 of the second connection part 42, and then fixing the stationary part 5*a* of the stationary bar 5 to the mounting face 422*c*, the shank part 112*c* extending from the slide metal frame-side coupling part 112*b* is surrounded by the stationary part 5*a* and the second retraction wall 422. This makes it possible to prevent the second connection part 42 from being detached from the slide metal frame-side coupling part 112*b*. In this way, the connection component 4 can be mounted to the slide metal frame-side coupling part 112*b*. In other words, the connection component 4 can be mounted to the slide metal frame 112 via the coupling frame 112*a*.

The connection component 4 mounted to the slide metal frame-side coupling part 112*b* of the slide metal frame 112 in the above manner is rotatable about the sliding directional central axis of the slide metal frame 112, as described above. This rotation of the connection component 4 can be manipulated by the grip 5*b*.

As shown in FIGS. 7A and 7B, the coupling frame 112*a* of the slide metal frame 112 is provided with an extension part 6 extending toward the connection component 4. The connection component 4 is positioned at a position where the first opening 414 faces the fixed metal frame 111, i.e., at a first position where the first opening 414 faces in the same direction as an opening-closing direction of the slide metal frame 112 (see FIG. 7A), by bringing a pin 7 provided on the connection component 4 into contact with the extension part 6. Here, the same direction as the opening-closing direction of the slide metal frame 112 is a direction orthogonal to the sliding surface of the slide metal frame 112.

When the connection component 4 is rotated, the grip 5*b* can be brought into contact with the extension part 6 to stop the rotation of the connection component 4 at a given position. In this embodiment, the grip 5*b* is brought into contact with the extension part 6 at a second position where the first opening 414 faces in the same direction as the attaching-detaching direction of the drive unit 12 (the direction orthogonal to the sliding direction of the slide metal frame 112 and along the sliding surface of the slide metal frame 112) (see FIG. 7B). Alternatively, the grip 5*b* may be brought into contact with the extension part 6 at a position lying slightly beyond the second position. This makes it possible to permit the grip 5*b* or the extension part 6 to thermally deform.

In this embodiment, the rotation of the connection component 4 is stopped by the grip 5*b*. Alternatively, for example, the same component as the pin 7 may be provided on the connection component 4 at a given position so as to stop the rotation of the connection component 4 when the first opening 414 comes to the second position.

Further, the grip 5*b* may be provided with a weight member. In the case where the grip 5*b* is provided with a weight member, instead of setting the center of gravity of the connection component 4 at a dimensional center thereof, the center of gravity of the connection component 4 is preferably offset from the dimensional center so as to allow the first opening 414 to more easily face the second position. This makes it possible to allow the first opening 414 to be located at the second position during casting by the weight of the grip 5*b* itself. Specifically, during casting, the slide metal frame 112 is disposed just below the fixed metal frame 111 in a horizontal posture. Thus, in the case where the grip 5*b* is provided with a weight member, the first opening 414 is urged to be located at the second position during casting by the weight of the grip 5*b* itself. When the first opening 414 is located at the second position, the slide metal frame 112 cannot be swingably opened or closed, so that it is possible to perform casting safely. Further, when the first drive unit 12*a* is detached in a foundry after casting, as described below, the first opening 414 is located at the second position, so that it is possible to detach the first drive unit 12*a* as it is.

In this embodiment, maintenance of the apparatus body 11, detaching of the plate 2 and replacement of the drive unit 12 are performed in a state in which the slide metal frame-side coupling part 112*b* of the slide metal frame 112 is coupled to the second connection part 42 of the connection component 4.

Maintenance of the apparatus body 11 and replacement of the plate 2 is performed in the surface pressure unloaded state. Thus, first of all, in order to unload the surface pressure, the first drive unit 12*a* having a relatively short stroke, which is used during casting, is replaced with the second drive unit 12*b* having a relatively long stroke.

In the operation of replacing the first drive unit 12*a* with the second drive unit 12*b*, the connection component 4 is rotated to move the first opening 414 of the first connection part 41 to the second position where the first opening 414 faces in the same direction as the attaching-detaching direction of the drive unit 12.

Figure 8:
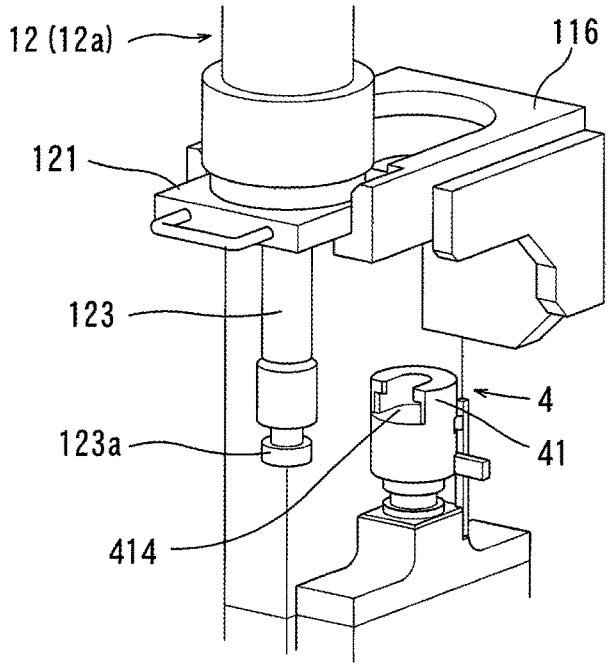
FIG. 8 is a perspective view showing a relevant part of the sliding nozzle apparatus in a state in which the drive unit is detached from the connection component.
Figure 9:
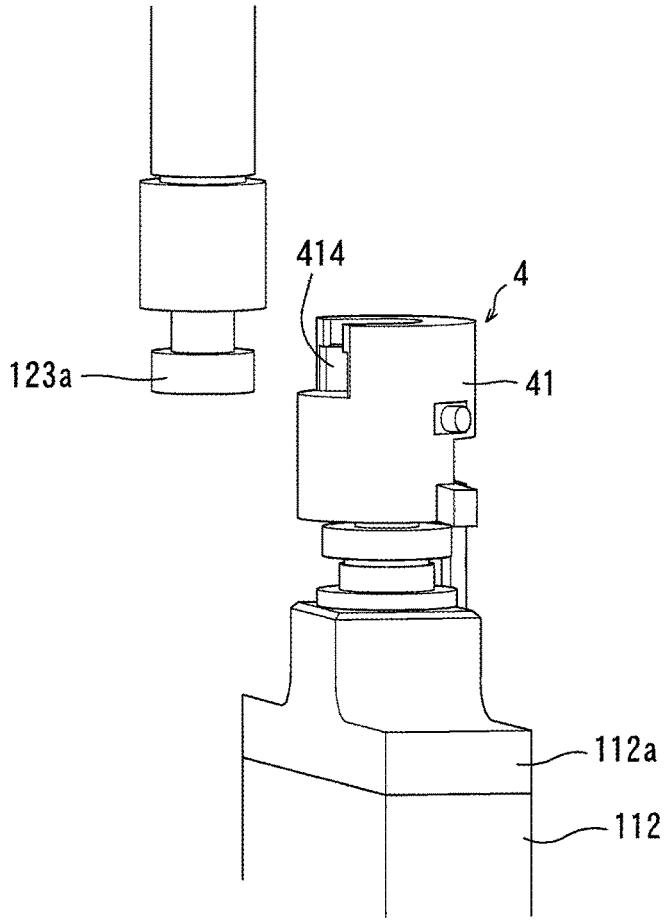
FIG. 9 is a perspective view showing a relevant part of the sliding nozzle apparatus in a state in which the slide metal frame is opened and thus the connection component is detached from the drive unit.

Then, the base plate 121 and the rod 123 of the first drive unit 12*a* are pulled out of the drive unit holder 116 along the attaching-detaching direction of the drive unit 12, and detached from the drive unit holder 116 (see FIG. 8).

Then, the base plate 121 and the rod 123 of the second drive unit 12*b* are inserted into the drive unit holder 116 along the attaching-detaching direction of the drive unit 12. In this process, the drive unit-side coupling part 123*a* is simultaneously inserted into the first connection part 41 along the attaching-detaching direction of the drive unit 12.

Subsequently, the surface pressure is unloaded by using the second drive unit 12*b*.

Secondly, in order to allow the slide metal frame 112 to be swingably opened and closed, the connection component 4 is rotated to move the first opening 414 of the first connection part 41 to the first position where the first opening 414 faces in the same direction as the opening-closing direction of the slide metal frame 112. This makes it possible to allow the first connection part 41 to be detached from and subsequently attached to the drive unit-side coupling part 123*a*, and thus allow the apparatus body 11 to be opened and subsequently closed (see FIG. 9). Then, in a state in which the slide metal frame 112 is opened, maintenance of the apparatus body 11 and replacement of the plate 2 can be performed.

After completion of the above operations, the slide metal frame 112 is swingably closed, and the surface pressure is loaded by using the second drive unit 12*b*.

Thirdly, in order to use the sliding nozzle apparatus 1 for casting, the drive unit 12 is changed from the second drive unit 12*b* to the first drive unit 12*a*. In the operation of replacing the second drive unit 12*b* with the first drive unit 12*a*, the connection component 4 is rotated to move the first opening 414 of the first connection part 41 to the second position where the first opening 414 faces in the same direction as the attaching-detaching direction of the drive unit 12, in a similar manner to that in the aforementioned operation of replacing the first drive unit 12*a* with the second drive unit 12*b*.

Subsequently, casting is performed in a state in which the first opening 414 of the first connection part 41 is located at the second position.

Here, in order to prevent the coupling between the connection component 4 and the drive unit-side coupling part 123*a* from being released during casting, the connection component 4 may be configured such that the first opening of the first connection part 41 is moved to a third position which is different from the first position where the first opening faces in the same direction as the opening-closing direction of the slide metal frame 112, and the second position where the first opening faces in the same direction as the attaching-detaching direction of the drive unit 12. In this case, in the operation of replacing the first drive unit 12*a* with the second drive unit 12*b*, the first opening 414 may be returned from the third position to the second position.

As mentioned above, in this embodiment, the drive unit-side coupling part 123*a* is inserted into or pulled out of the first connection part 41 of the connection component 4 from different directions, respectively, during opening and closing of the slide metal frame 112 and during replacement of the drive unit 12. Specifically, a direction along which the first connection part 41 is detached from and attached to the drive unit-side coupling part 123*a* when the slide metal frame 112 is swingably opened and closed is the same direction as the opening-closing direction of the slide metal frame 112, i.e., a direction orthogonal to the sliding surface of the slide metal frame 112. On the other hand, a direction along which the drive unit-side coupling part 123*a* is detached from and attached to the first connection part 41 when the drive unit 12 is replaced is the same direction as the attaching-detaching direction of the drive unit 12, i.e., a direction orthogonal to the sliding direction of the slide metal frame 112 and along the sliding surface of the slide metal frame 112.

Further, if there is a step of detaching the connection component 4 from the slide metal frame 112, such an operation needs to take a lot of time. Thus, it is necessary to perform the opening and closing operation and the attaching and detaching operation without detaching the connection component 4 from the slide metal frame 112. This requires a configuration for allowing the connection component 4 to be attached to and detached from the drive unit-side coupling part 123*a*, correspondingly to the above two different directions.

In this embodiment, the connection component 4 is configured to be rotatable, thereby allowing the position (direction) of the first opening 414 of the first connection section 41 to be switched. As a result of using this configuration, even in a state in which the connection component 4 is mounted to the slide metal frame 112, it becomes possible to perform both the replacement of the drive unit 12 and the opening and closing of the slide metal frame 112, while switching the direction of the first opening 414, thereby shortening a required time of the operation.

Further, the number of openings in the first connection part 41 can be limited to one, so that it is possible to enhance the strength of the first connection part 41, as compared to a case where a plurality of opening are provided in conformity to the different attaching-detaching directions of the drive unit-side coupling part 123*a*.

In this embodiment, the drive unit-side coupling part 123*a* is disposed in the space surrounded by the first advance wall 411, the first retraction wall 412 and the first intermediate wall 413 of the first connection part 41, so that the position of the drive unit-side coupling part 123*a* is less likely to be displaced during use. Further, the drive unit-side coupling part 123*a* is less likely to be detached from the first connection part 41. This makes it easier to transmit a driving force of the drive unit 12 to the slide metal frame 112 more efficiently and more evenly, even through the connection component 4.

In this embodiment, the attaching-detaching direction of the drive unit 12 is a direction orthogonal to the sliding direction of the slide metal frame 112 and along the sliding surface of the slide metal frame 112. Alternatively, it may be a direction orthogonal to the sliding surface of the slide metal frame 112. In this case, in the operation of attaching and detaching the drive unit-side coupling part 123*a* of the drive unit 12 with respect to the first connection part 41, the first opening 414 may be moved to face in the direction orthogonal to the sliding surface of the slide metal frame 112.

In this embodiment, the connection component 4 is formed in a cylindrical shape. However, the connection component 4 is not limited thereto, but may take any of various other shapes, such as a spherical shape or a cubic shape.

Although this embodiment has been described based on an example where two drive units 12*a*, 12*b* having different strokes are replaced, the present invention is not limited thereto. For example, the present invention may be applied to a case where a plurality of drive units 12 having the same stroke are replaced during maintenance or the like.

In this embodiment, the apparatus body 11 comprises the fixed metal frame 111, the slide metal frame 112 and the spring boxes 113. However, the apparatus body is not limited thereto, but may take any of various other configurations. For example, the apparatus body may comprise: a fixed metal frame; an openable and closable metal frame provided in a manner swingably openable and closable with respect to the fixed metal frame; and a slide metal frame attached to the openable and closable metal frame, wherein the slide metal frame is provided such that it is swingably opened and closed with respect to the fixed metal frame through the openable and closable metal frame. As above, the slide metal frame 112 may be provided such that it is swingably openable and closable with respect to the fixed metal frame 111 though another member.

LIST OF REFERENCE SIGNS

1: sliding nozzle apparatus
11: apparatus body
111: fixed metal frame
112: slide metal frame
112*a*: coupling frame
112*b*: slide metal frame-side coupling part
112*c*: shank part
113: spring box
114: pivot shaft
115: bottom plate
115*a*: groove
116: drive unit holder
116*a*, 116*b*: arm part
116*c*: inter-arm coupling part
117: base plate insertion part
12: drive unit
12*a*: first drive unit
12*b*: second drive unit
121: base plate
122: cylinder
123: rod
123*a*: drive unit-side coupling part
2: plate
2*a*: nozzle hole
3: housing part
3*a*: through-hole
4: connection component
41: first connection part
411: first advance wall
412: first retraction wall
412*a*: first through-recess
412*b*: first step
413: first intermediate wall
414: first opening
42: second connection part
421: second advance wall
422: second retraction wall
422*a*: second through-recess
422*b*: second step
422*c*: mounting face
423: second intermediate wall
424: second opening
5: stationary bar
5*a*: stationary part
5*b*: grip
6: extension part
7: pin

The invention claimed is:

1. A sliding nozzle apparatus comprising:

a fixed metal frame;

a slide metal frame configured to be openable and closable, with respect to the fixed metal frame, in an opening-closing direction;

a drive unit for sliding the slide metal frame in a sliding direction with a sliding surface of the slide metal frame sliding against a surface of the fixed metal frame; and a connection component attached to the slide metal frame and configured for connection with the drive unit, wherein the connection component has a first opening with respect to which the drive unit can be attached and detached only in one attaching-detaching direction, wherein the connection component is configured to allow the first opening to be positioned between a first position where the first opening is oriented in a same direction as the opening-closing direction of the slide metal frame, and a second position where the first opening is oriented in a same direction as the attaching-detaching direction of the drive unit, wherein when the first opening of the connection component is positioned in the first position, the slide metal frame can be opened and closed through the first opening and when the first opening of the connection component is positioned in the second position, the drive unit can be attached and detached, wherein the connection component is rotatable with respect to the slide metal frame, with the connection component rotating about a central axis of a rod portion of the drive unit and can contact the rod portion during rotation, and wherein a position of the first opening is switchable between the first position and the second position by rotation of the connection component.

2. The sliding nozzle apparatus as claimed in claim 1, wherein the connection component has a wall facing in the sliding direction and wherein the wall has a recess in which at least part of the drive unit is inserted, the recess configured to restrict at least a part of the drive unit inserted in the recess to be displaced in a direction orthogonal to the sliding direction.

3. The sliding nozzle apparatus as claimed in claim 1, wherein the connection component further comprises a second opening to which the slide metal frame is mountable and wherein the first opening and the second opening are oriented in opposite directions.

4. The sliding nozzle apparatus as claimed in claim 1, wherein the fixed metal frame has a bottom plate extending toward the drive unit and wherein the fixed metal frame is configured to have a gap between the bottom plate and the connection component.

5. The sliding nozzle apparatus as claimed in claim 1, wherein the one attaching-detaching direction is a direction orthogonal to the sliding direction and along a sliding surface of the slide metal frame.

6. The sliding nozzle apparatus as claimed in claim 1, wherein the one attaching-detaching direction is a direction orthogonal to the sliding direction and orthogonal to the sliding surface of the slide metal frame.

7. The sliding nozzle apparatus as claimed in claim 1, wherein the rod portion of the drive unit is configured for passing through the first opening of the connection component to attach and detach the drive unit when the slide metal frame is closed.

* * * * *